United States Patent [19]

McNair

[11] 4,062,289

[45] Dec. 13, 1977

[54] MOUNTING BRACKET

[75] Inventor: Rhett McNair, Orange, Calif.

[73] Assignee: Aqua-Craft, Inc., San Diego, Calif.

[21] Appl. No.: 615,980

[22] Filed: Sept. 23, 1975

[51] Int. Cl.[2] ..... F42B 13/54; A47F 7/00; F41C 33/00; A47K 1/08

[52] U.S. Cl. ..... 102/48; 211/60 T; 224/1 R; 224/5 B; 248/359; 248/509

[58] Field of Search ..... 102/48, 54; 124/41 R, 124/71, 74, 21, 22, 25, 17, 20 B, 29, 2; 43/6; 42/1 L, 85; 248/509, 359, 358 R, 311, 375, 386, 309; 224/8 R, 5 B, .5, 1 R, 1 A, 2 R, 3; 280/11.37 E; 211/60 SK, 60 T

[56] References Cited

U.S. PATENT DOCUMENTS

| | | | |
|---|---|---|---|
| 2,432,802 | 12/1947 | Reynolds | 89/45 |
| 2,614,355 | 10/1952 | Rogers | 42/85 |
| 2,822,730 | 2/1958 | Brennan | 89/45 |
| 3,153,875 | 10/1964 | Califano | 43/6 |
| 3,231,950 | 2/1966 | Lummis | 248/509 |
| 3,300,888 | 1/1967 | Belcher | 42/1 L |
| 3,483,865 | 12/1969 | Jansson | 248/359 |
| 3,747,247 | 7/1973 | McNair | 102/48 |
| 3,907,182 | 9/1975 | Bryant | 224/2 B |
| 3,927,808 | 12/1975 | Steen | 42/85 |

*Primary Examiner*—Verlin R. Pendegrass
*Assistant Examiner*—Donald P. Walsh
*Attorney, Agent, or Firm*—James C. Wray

[57] ABSTRACT

A powerhead mounting bracket is connected to a diver's breathing tank support. A cord connected to the receiver has a plug with a projection for loosely fitting in an axial bore of the powerhead. The plug is placed in the axial bore and the powerhead shaft is placed between the flanges on the receiver. The sling at the other end of the powerhead is stretched, forcing the powerhead tight against the plug, and the stretched spring is hooked into slots in the receiver. The stretched sling holds the shaft of the powerhead against the base of the receiver and holds the powerhead longitudinally against the plug. When required for use, the powerhead shaft is grasped near the firing end and is pushed in a direction towards the sling, further stretching the sling. When the plug drops out of the axial bore, the shaft is pulled outward from the receiver, allowing the sling to become untensioned, whereupon the sling drops out of the slot in the receiver.

9 Claims, 7 Drawing Figures

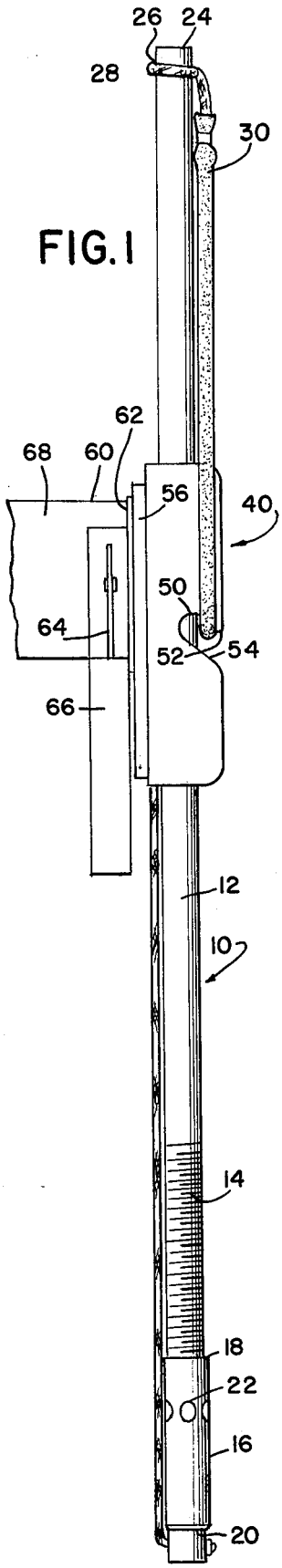
FIG. 1
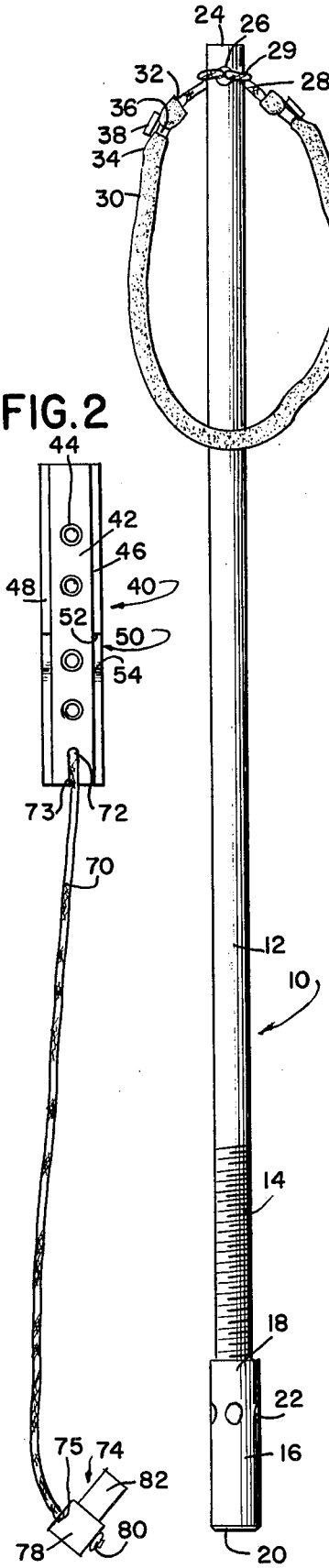
FIG. 3
FIG. 2
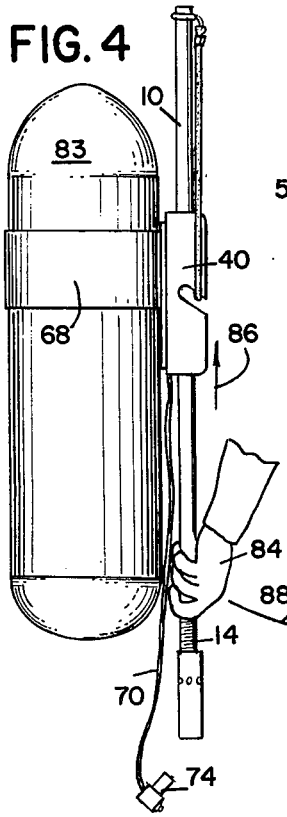
FIG. 4
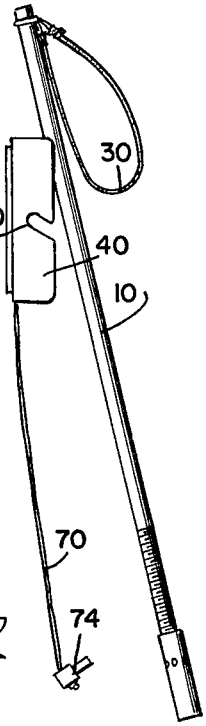
FIG. 5
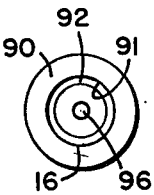
FIG. 6
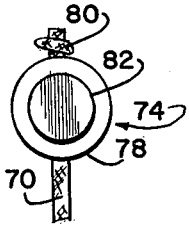
FIG. 7

MOUNTING BRACKET

BACKGROUND OF THE INVENTION

Powerheads are designed for the use underwater in defensive situations to kill large fish, especially sharks. Chances of being in a combative situation with a shark are remote. Rarely does a diver have to resort to killing a shark to deter an attack. However, when a situation does indicate an imminent attack, it is important to have a defensive weapon.

Several powerheads have been developed for carrying as defensive weapons by divers. Most of the powerheads fire a projectile into the body of a shark when the end of the powerhead is jammed sharply against the shark.

A description of the desirable powerhead is contained entitled "Sea-Way Fast-Load Shark Shooter" in the April, 1975, issue of *Skin Diver* magazine.

All of the available powerheads require hand carrying during swimming. The powerhead usually becomes cumbersome and difficult to carry while performing other operations. In some situations the need to have a powerhead is high, yet the need to actually employ the powerhead is low. Usually a diver elects to be encumbered by carrying the powerhead in the event that its need may become critical during particular dives. This has meant that the diver must carry the powerhead in his hand throughout the dive.

SUMMARY OF THE INVENTION

The present invention provides a ready carrying device for a powerhead so that the powerhead need not be hand carried throughout a dive.

The invention comprises a bracket that is mounted on a breathing tank carrier. In a preferred form of the bracket a receiver has a U-shaped cross section and an elongated base with parallel elongated flanges integrally formed on sides of the base. An extension extends outward from the receiver and engagement means is connected to the extention remote from the receiver. The engagement means has a portion which fits a complementary portion of the powerhead or tool which is being carried.

In a preferred embodiment, the extension is a flexible high strength cord having one end connected to the receiver. The engagement means is a plug having a hole through which the other end of the cord is threaded. The remote end of the cord is finally knotted and bonded to the plug.

In a preferred form of the invention, the plug has a projection which fits into an opening in the powerhead of the tool. Preferably the cord extends through the plug in a direction transverse to the projection, whereby stretching the cord tends to turn the plug, tending to misalign the projection with the opening, tightening the normally loose-fitting projection in the opening.

The receiver has a spring-holding means for holding a spring which urges the tool toward the engagement means. In the preferred form of the invention, the same spring which urges the tool towards the engagement means also holds the tool toward the base between the parallel flanges.

In a preferred form of the invention, the tool has a stretchable spring connected to an end of the tool opposite the engagement means, and the stretchable spring fits in the spring-holding means to perform both holding functions.

It will be appreciated that, while the receiver and extension portion of the invention are designed primarily for use with a powerhead, their use with other tools may be accomplished by those skilled in the art.

In the preferred embodiment of the invention, the mounting bracket and its powerhead are integrally designed as a unit, which is made, sold, and used together. The dimension of the powerhead and the dimension of the receiver and the extention and engagement means are coordinated so that the sling-type spring of the powerhead hooks in the receiver to stretch the spring sufficiently to tighten the plug projection in the axial bore of the firing chamber.

One object of the invention is the provision of a tool mounting bracket.

A primary object of the invention is the provision of a mounting bracket for mounting a powerhead on an underwater breathing tank carrier.

A principal object of the invention is the provision of the combination of a powerhead mounting bracket and a powerhead mounted in a carrying bracket.

One object of the invention is the provision of a tool-mounting bracket with a receiver for receiving a tool, an extension connected to the receiver and extending outward from the receiver, tool-engaging means connected to the extension remote from the receiver for engaging the tool, and spring-holding means connected to the receiver for holding a spring to urge the tool into continued engagement with the engaging means.

The invention has as another object the provision of a tool-mounting bracket having a U-shaped receiver, with a base and flanges on opposite sides of the base extending outward from the base, and a spring-holding means mounted in the flanges remote from the base, so that a tool positioned in the receiver between the flanges and along the base is held toward the base by a spring in the spring-holding means, whereby a spring holds the tool inward against the base and urges the tool longitudinally into continued engagement with an engaging means.

Another object of this invention is the provision of a tool-mounted bracket with a flexible extension, and an engaging means on the extension having a structure to fit a complementary structure on the tool.

The invention has as another object the provision of a tool-mounting bracket with an extension cord having one end connected to the receiver and having the other end connected to a plug having a projection for extending into an opening in a tool.

Another object of the invention is the provision of a tool-mounting bracket with an extension cord extending through a hold in a plug transverse to a projection which extends in normally loose fit into an end opening in the tool.

The invention has as another object the provision of a tool-mounting bracket with a spring-holding means composing hooks in a receiver for holding a loop-type spring connected to an end of a tool remote from an engaging means.

The invention has as a further object the provision of a powerhead holding bracket for mounting on a diver's breathing tank a sling-type powerhead having an elongated shaft with a sling-type spring connected to a first end of the shaft and a firearm type chamber with an axial bore opening at the other end of the shaft, wherein a plug with a projection fits loosely within the bore and wherein the sling is stretched and is connected to a spring-holding means on the bracket, whereby the sling pulls the powerhead shaft through the receiver toward the plug and whereby the plug resists further movement.

Another object of the invention is the provision of a powerhead holding bracket wherein a receiver has a U-shaped cross section with an elongated base and parallel lateral flanges connected to the base, with a longitudinal opening between the flanges remote from the space for receiving the powerhead shaft and with openings between the flanges at opposite longitudinal ends for allowing the passage of the powerhead shaft, and wherein the spring-holding means is connected to the flanges remote from the base, whereby the sling engaging the spring-holding means holds the shaft inqard in the receiver toward the base and wherein the receiver has mounting means for mounting the receiver on a breathing tank support.

Another object of the invention is the provision of a powerhead holding bracket wherein the spring-holding means comprises parallel outward opening slanted slots in the flanges with the slots directed in a sloping direction toward the engagement means, whereby hooks are formed by the slots on sides of the slots remote from the engagements means for hooking and holding a stretched sling of the powerhead.

A further object of the invention is the provision of a powerhead holding bracket wherein the shaft of the powerhead is roughened adjacent the firearm chamber for grasping the shaft and sliding the shaft through the receiver in a direction away from engagement means and in a sling stretching direction to disengage the engagement means and to permit the shaft to be removed from the receiver.

These and other and further objects of the invention are apparent in the disclosure which includes the specification and claims and drawings.

FIG. 1 is a showing of an assembled powerhead and mounting bracket.

FIG. 2 is a front elevation of the mounting bracket, extension and plug.

FIG. 3 is a front elevation of the powerhead with the rubber sling.

FIG. 4 is a detail of the mounting bracket mounted on the band which surrounds a diver's air tank and showing the upward movement of the powerhead to release the plug.

FIG. 5 is a further detail showing the removal of the powerhead from the bracket.

FIG. 6 is a detail of the end of the powerhead into which the plug fits.

FIG. 7 is a detail of the plug.

Referring to FIG. 1, a powerhead is generally indicated by the numeral 10 and powerhead 10 has a shaft 12 which is roughened or knurled 14 near one end to provide a gripping area. A powerhead chamber 16 is mounted on the shaft 12 near the gripping area 14. End 18 of the chamber 16 is configured to receive the shaft as an integral part of the powerhead. Opposite end 20 is open for receiving the shark killing load in the powerhead chamber. Holes 22 permit water to flow out of chamber 16 as a load is driven towards a firing pin in end 18 of chamber 16.

The opposite end 24 of shaft 12 is provided with a hole 26 through which a cord 28 is looped. The central portion of cord 28 is passed through the hole and a loop 29 is formed and is passed over the end 24 of the shaft to fix the cord to the shaft. A rubber sling 30 of a conventional tough tubular construction such as surgical tubing is connected to ends of the cord 28.

The extreme ends of the cord 28 are knotted. The knotted ends of the cord are inserted in open ends 32 of sling 30 into an area 34 of the tubular sling. Clamps 36 are secured by keepers 38, tightly pulling the sling on the cord.

The powerhead shown in FIGS. 1 and 3 is a particularly new and useful invention, since the powerhead is extremely short as compared with prior art powerheads. When a spring 30 is tensioned, by inserting the loop of the spring between the thumb and forefinger and sliding the hand along the shaft 12, the roughened area 14 is gripped, with the hand immediately adjacent the chamber 16.

When the weapon is used, the closeness of the hand to the chamber insures good placement of the chamber opening 20 against the shark as the roughened surface 14 is released, causing spring 30 to drive the powerhead toward the shark.

As shown in FIGS. 1 and 2, the mounting bracket 40 has a base 42 with holes 44 for securing the base to a airtank mounting structure. Parallel flanges 46 and 48 tightly grip the shaft 12. Upward slanted openings 50 provide hooks 52 for holding the sling 30 in a stretched position. The rounded downward edges 54 of the openings 50 permit the sling to drop from the openings when the powerhead is being removed.

As shown in FIG. 1, the bracket is mounted on a diver's air tank support 60. The back 56 of the support is firmly attached to a fixed object on the band such as one side of 62 of the air tank clamping mechanism represented by numerals 64 and 66. The tank holding band 68 surrounds the tank and is firmly clamped by element 66 to element 62. Alternatively, a clip may be provided on back 56 of the bracket which fits over the thin band 68 as shown in FIG. 4.

The bracket is completed by a cord 70 having one end which passes through opening 72 in base 42 of the bracket and which is mounted on the far side of the bracket. A groove 73 in base 44 permits the cord 70 to lie flat in the base.

A plug 74 is provided at the remote end of the cord. Plug 74 has a hole 75 in its large base portion 78. The cord is knotted 80 and is fused such as by heating, to cause the knot to be permanent.

Projection 82 on the plug, as shown in FIGS. 2 and 7, fits within an opening in end 20 of the powerhead chamber.

As shown in FIG. 1, when the projection of the plug is inserted in the opening in end 20 of the powerhead and the cord 70 is stretched tight, the shaft 12 of the powerhead is positioned between the flanges of bracket 40 and stretched spring 30 is held by hooks 52, urging the powerhead tightly downward against the plug.

As shown in FIG. 4, the powerhead is stored behind the diver on the mounting rig for his air tank 83 until the diver desires to use the powerhead or have it readily available. The diver reaches behind him with one hand 84 and grasps the shaft of the powerhead in the roughened area 14. Forcing powerhead 10 upward in the direction of arrow 86 causes the plug 74 to fall out of the chamber. The diver then moves his hand in the direction of arrow 88, releasing the tension of spring 30 and causing the spring to drop out of the groove 50 in the bracket. The powerhead freely leaves the bracket as the diver continues to move the powerhead outward with a sweeping motion of his arm. Finally, the diver retains the powerhead by the roughened area 14 while his other hand is used to load a cartridge into the chamber.

As shown in the end view of FIG. 6, chamber 16 has a beveled end 90 with an opening 91, in which the projection 82 fits. Deep within the chamber 16 is a ledge 92 on which it is integrally formed a firing pin 96 against which the cartridge is driven to fire the entire cartridge out of chamber 16 into the body of the shark.

While the invention has been described with reference to specific embodiments, it will be obvious to those skilled in the art that modifications and variations of the invention may be made without departing from the scope of the invention. The scope of the invention is defined in the following claims.

I claim:

1. A tool mounting bracket comprising a receiver for receiving a tool, a flexible extension connected to the receiver and extending outward from the receiver, tool engaging means having a complementary structure connected to the extension remote from the receiver for engaging a complementary structure on the tool, and spring-holding means connected to the receiver for holding a spring to urge the tool into continued engagement with the engaging means.

2. The tool mounting bracket of claim 1 wherein the receiver has a U-shaped cross section with a base and flanges on opposite sides of the base extending outward from the base, and wherein the spring-holding means is mounted in the flanges remote from the base, wherein a tool positioned in the receiver between the flanges and along the base is held toward the base by a spring in the spring-holder means so that a spring holds the tool inward against the base as well as into continued engagement with the engaging means.

3. The tool mounting bracket of claim 1 wherein the extension is a cord having one end connected to the receiver and having the other end connected to a plug having a projection for extending into an opening in the tool.

4. The tool mounting bracket of claim 3 wherein the cord extends through a hole in the plug transverse to the projection, and wherein the projection extends in loose fit into an end opening in the tool.

5. The tool mounting bracket of claim 1 wherein the spring-holding means comprises hooks in the receiver for holding a loop-type spring connected to an end of the tool remote from the engaging means.

6. The tool mounting bracket of claim 1 wherein the bracket is a powerhead holding bracket for mounting on a support for a diver's breathing tank, and further comprising a sling-propelled powerhead mounted in the bracket, the powerhead having an elongated shaft with a sling-type spring connected to a first end of the shaft and a firearm type chamber with an axial bore opening at the other end of the shaft, wherein the engagement means comprises a plug with a projection fitting loosely within the bore and wherein the sling is stretched and is connected to the spring-holding means whereby the sling pulls the powerhead shaft through the receiver toward the plug, whereby the plug resists further movement.

7. The powerhead holding bracket of claim 6 wherein the receiver has a U-shaped cross section with an elongated base and parallel lateral flanges connected to the base, with a longitudinal opening between the flanges remote from the space for receiving the powerhead shaft and with openings between the flanges at opposite longitudinal ends for allowing the passage of the powerhead shaft, and wherein the receiver has mounting means for mounting the receiver on a breathing tank support.

8. The powerhead holding bracket of claim 7 wherein the spring-holding means comprises parallel outward opening slanted slots in the flanges with the slots directed in a sloping direction toward the engagements means, whereby hooks are formed by the slots on sides of the slots remote from the engagements means for hooking and holding a stretched sling of the powerhead.

9. The powerhead holding bracket of claim 6 wherein the shaft of the powerhead is roughened adjacent the firearm chamber for grasping the shaft and sliding the shaft through the receiver in a direction away from engagement means and in a sling stretching direction to disengage the engagement means and to permit the shaft to be removed from the receiver.

* * * * *